US008277568B2

(12) United States Patent
Neplenbroek et al.

(10) Patent No.: US 8,277,568 B2
(45) Date of Patent: Oct. 2, 2012

(54) RINSE AID

(75) Inventors: Antonius Maria Neplenbroek, Soest (NL); Fabien Bruno Dusart, Rillieux-la-Pape (FR); Amandine Aurelie Marie Houche, Paris (FR); Diederick Hendricus Van Drunen, De Bilt (NL)

(73) Assignee: Diversey, Inc., Sturtevant, WI (US)

( * ) Notice: Subject to any disclaimer, the term of this patent is extended or adjusted under 35 U.S.C. 154(b) by 0 days.

(21) Appl. No.: 12/665,410

(22) PCT Filed: Jul. 3, 2008

(86) PCT No.: PCT/US2008/069220

§ 371 (c)(1),
(2), (4) Date: Mar. 3, 2010

(87) PCT Pub. No.: WO2009/006603

PCT Pub. Date: Jan. 8, 2009

(65) Prior Publication Data

US 2010/0224221 A1 Sep. 9, 2010

Related U.S. Application Data

(60) Provisional application No. 60/956,487, filed on Aug. 17, 2007.

(30) Foreign Application Priority Data

Jul. 5, 2007 (EP) ..... 07111855

(51) Int. Cl.
*C11D 1/62* (2006.01)

(52) U.S. Cl. ..... 134/25.2; 134/26; 510/220; 510/504; 510/514

(58) Field of Classification Search ..... 134/25.2, 134/26; 510/220, 504, 514
See application file for complete search history.

(56) References Cited

U.S. PATENT DOCUMENTS

| | | | | |
|---|---|---|---|---|
| 4,101,456 | A | 7/1978 | Renaud et al. | |
| 4,576,744 | A | 3/1986 | Edwards et al. | |
| 6,172,036 | B1 * | 1/2001 | Cruickshank et al. | 510/514 |
| 6,239,091 | B1 * | 5/2001 | Tartakovsky et al. | 510/220 |
| 2003/0073596 | A1 | 4/2003 | Chiou et al. | |
| 2005/0075258 | A1 | 4/2005 | Kessler et al. | |
| 2006/0058209 | A1 | 3/2006 | Lentsch et al. | |
| 2007/0017553 | A1 | 1/2007 | Neplenbroek et al. | |
| 2010/0154831 | A1 | 6/2010 | Neplenbroek et al. | |

FOREIGN PATENT DOCUMENTS

| | | |
|---|---|---|
| JP | 2007099811 | 4/2007 |
| JP | 2007169473 | 7/2007 |
| WO | 02/06438 | 1/2002 |
| WO | 2004/061069 | 7/2004 |
| WO | WO 2004091557 A2 * | 10/2004 |
| WO | 2006/119162 | 11/2006 |
| WO | WO2008144744 | 11/2008 |

OTHER PUBLICATIONS

Office Action received in Chinese Application No. 200880023506.7, Dec. 31, 2010.
International Search Report prepared by the European Patent Office, Mailing date: Oct. 15, 2008.

* cited by examiner

*Primary Examiner* — Michael Barr
*Assistant Examiner* — Caitlin N Dunlap
(74) *Attorney, Agent, or Firm* — Gregory S. Bollis

(57) ABSTRACT

A method of washing ware in an automatic ware washing machine, is disclosed, using a rinse aid composition containing a polysaccharide. The polysaccharide adsorbs on the ware resulting in a sheeting action of the rinse solution leading to improved drying of the ware.

8 Claims, No Drawings

RINSE AID

FIELD OF THE INVENTION

This invention relates to an automatic ware washing process using a rinse aid that promotes rinsing or rinse water sheeting in the rinsing stage.

BACKGROUND OF THE INVENTION

Current automatic warewash processes involve at least 2 steps. The automatic warewash process comprises a main wash in which the substrates are cleaned by pumping a main wash solution over the substrates via nozzles. The main wash solution is obtained by dissolving main wash detergent, which may contain components such as alkalinity agents, builders, bleaches, enzymes, surfactants, polymers, corrosion inhibitors etc. A further step comprises rinsing after the main wash. This rinse cycle comprises flowing warm or hot water, often containing a rinse aid, over the substrates, which may be followed by a hot air stream to further improve the drying process.

Such automatic processes take place in both domestic as well as institutional ware washing machines. There are significant differences in process parameters between these 2 type of machines, which are for instance described in international patent application WO 2006/119162. The rinse cycles in these processes vary from a few seconds (for some institutional machines) up to 40 minutes (for some domestic machines). The temperature of the rinse solution typically varies between 40 and 90° C. Despite these different parameters, both domestic and institutional processes involve a main wash and a rinse step.

The rinse solution often contains a rinse aid. Such a rinse aid typically is a liquid comprising non-ionics present in an amount of 10 to 30% in water, often in combination with hydrotropes and sometimes other additives such as acids, corrosion inhibitors, bleaches, etc. The function of the rinse aid is to provide a sheeting action of the rinse solution, which leads to improved drying of the ware and enhanced visual appearance after drying.

The presence of surfactants in current rinse aids for ware washing processes (both domestic and institutional) is considered to be essential since these surfactants reduce the surface tension of the rinse solution and so lead to improved drying properties of the substrates. The majority of these surfactants are nonionics. Hydrotopes are also important for keeping the surfactants into solution. Sometimes other components may also be present in the rinse aid; e.g. perfume, color components, acid and other scale inhibitors (to prevent scale formation on substrates and machine parts), corrosion inhibitors, soil release agents (leaving behind a thin layer leading to improved cleaning in next cleaning cycle), anti-spotting components (improving visual appearance, such as spot free drying esp. on glass).

The drying properties of rinse aids thus are primarily determined by the nonionic surfactants. Without these nonionics the substrates would not become dry or would have many spots and water marks after drying.

The presence of nonionic surfactants in current rinse aids also has several disadvantages or limitations:

Proper drying is not always obtained due to limited effectiveness. This necessitates drying with a cloth or accepting longer drying time.

Use of nonionics can have negative effects on visual appearance. Smears and streaks of residual nonionics can become visible, especially on glass.

Use of nonionics with wetting properties can lead to foam forming in the wash bath. This requires the need for a separate nonionic with defoaming properties in the rinse aid composition.

Additional of a hydrotrope is often needed to create a stable liquid rinse aid formulation.

Most nonionics are not stable or compatible in combination with acids and/or bleaches.

Most nonionics are not food approved.

Rinse aid nonionics are often difficult to disperse in the rinse solution. High mechanical forces are needed to create a homogeneous rinse solution. For this reason, rinse aids are mosttimes dosed before the boiler of institutional dishwash machines.

Residual nonionics, attached to substrates, can have negative effects on soil adhesion and for instance lead to starch build up.

WO 2004/061069 discloses a rinse aid composition comprising: a) from 0.01 to 70 wt % of at least one water-soluble metal salt; b) from 0.01 to 25 wt % of an acid; c) from 0.01 to 60 wt % of a non-ionic surfactant; d) at least a dispersant polymer and/or a perfume; and wherein said rinse aid composition has a pH of less than 5 when measured at 10% concentration in an aqueous solution. Dispersant polymers are useful in rinse aid compositions because they disperse particles in the wash solution or rinse water and so prevent particle disposition on the ware.

The present invention discloses new rinse compositions and methods that utilize polysaccharides, which can solve most of the issues and limitations of standard rinse aids. In these new compositions and methods, nonionic or other surfactants may not be required in the rinse aid for proper drying. Rather, polysaccharides present in the rinse compositions may adsorb to a washware substrate and provide for better wetting and subsequent drying of the substrate in the absence of nonionic or other surfactants, which are utilized to reduce the surface tension of the surface solution.

SUMMARY AND DESCRIPTION OF THE INVENTION

Rinse aid compositions and methods for washing ware in an automatic ware washing machine are provided. In the disclosed methods, a rinse aid composition is used that comprises a polysaccharide which has been observed to improve drying behavior. The rinse aid composition typically is added or dosed to an aqueous solution to prepare an aqueous rinse solution in which the polysaccharide is present at a suitable concentration for providing a layer of polysaccharide on the ware during a rinse cycle. Furthermore, the aqueous rinse solution may provide a sheeting action on the washed ware during the rinse cycle. The polysaccharide preferably provides improved drying of the ware and may obviate the need for using nonionic surfactants in the rinse aid composition (i.e., where the presence of nonionic surfactants in the rinse aid composition is not required in order to obtain suitable drying times or suitable drying characteristics for the washed ware).

In particular, the method may comprise:

(a) contacting the ware during a wash cycle with an aqueous cleaning solution, and (b) contacting the washed ware during a rinse cycle with an aqueous rinse solution in which a rinse aid composition may be added or dosed, wherein the aqueous rinse solution contains a sufficient amount of a polysaccharide to provide a layer of polysaccharide on the ware, and wherein the aqueous rinse solution may provide a sheeting action during the rinse cycle.

In some embodiments, the polysaccharide preferably constitutes 0.01% to 100% (w/w) of the rinse aid composition (which may be wet or dry), more preferably 0.1% to 20% (w/w), most preferably 1.0% to 10% (w/w), based on total (wet or dry) weight of the rinse aid composition. The polysaccharide may be dosed to the aqueous rinse solution in any suitable form, including but not limited to, solid form (e.g., as powder or granulate), and liquid form (e.g., as an aqueous solution).

The rinse aid composition further may be added or dosed to an aqueous composition in order to prepare an aqueous rinse solution. In some embodiments, the polysaccharide is present in the aqueous rinse solution at a concentration of about 1 to about 10000 ppm, more preferably about 5 ppm to about 1000 ppm, even more preferably about 10 to about 100 ppm. In even further preferable embodiments, the polysaccharide is present in the aqueous rinse solution at a concentration of at least about 1, 5, or 10 ppm.

The disclosed rinse aid compositions and uses thereof in washing ware methods may achieve desirable drying properties for the washed ware. The drying properties provided by the disclosed rinse aid compositions may be so effective that typically no nonionic surfactants may be needed for proper drying of the substrates (e.g., where suitable drying times may be observed and minimal spotting may be observed in the absence of nonionic surfactants). In some embodiments, a rinse aid composition is used that contains a nonionic surfactant in a concentration of no more than about 10% (w/w), preferably no more than about 5% (w/w), more preferably no more than about 2% (w/w). In further embodiments, the disclosed rinse aid compositions do not comprise a nonionic surfactant. The rinse aid compositions may be added or dosed to an aqueous solution in order to prepare an aqueous rinse solution comprising a nonionic surfactant at a concentration of no more than about 1000 ppm, preferably no more than about 100 ppm, even more preferably no more than about 10 ppm. Where the rinse aid composition does not comprise a nonionic surfactant, the rinse aid composition may be used to prepare an aqueous rinse solution that does not comprise a nonionic surfactant.

Preferably, a polysaccharide that is suitable for use in the rinse aid should sufficiently adsorb on a solid surface leading to overall improved drying behavior (reduced drying time).

The suitability of polysaccharides for use in the compositions and methods disclosed herein may be determined by comparing the drying behavior of a substrate under identical conditions using a ware washing process comprising a main wash step and a rinse step, wherein a rinse solution is used with or without the presence of the polysaccharide.

Drying behavior may be assessed on any suitable substrate, including but not limited to, drying coupons that are made of material that is representative of washware. Drying coupons may comprise washware material that is very difficult to dry in ware washing processes without the use of rinse components. Substrates utilized to assess drying behavior in the present disclosure included:

- 2 glass coupons (148*79*4 mm)
- 2 plastic ('Nytralon 6E' (Quadrant Eng Meering Plastic Products); naturel) coupons (97*97*3 mm)
- 2 stainless steel cups (110*65*32 mm), model: Le Chef, supplier: Elektroblok BV.

Drying behavior may be measured as drying time (seconds) and as residual amount of droplets after 5 minutes. These measurements may be calculated immediately after opening a washware machine.

Drying behavior with polysaccharides present in the rinse aid also may be quantified by calculating a drying coefficient. This coefficient can be calculated both for the drying time and for the number of remaining droplets after 5 minutes and may correspond to one or both of the following ratios:

$$\frac{\text{Drying time using rinse aid with polysaccharide}}{\text{Drying time using rinse aid without polysaccharide}}$$

and $$\frac{\text{Number of droplets after 5 minutes using rinse aid with polysaccharide}}{\text{Number of droplets after 5 minutes using rinse aid without polysaccharide}}$$

When a drying coefficient is calculated using these ratios, better drying behavior corresponds with a lower drying coefficient. Average drying coefficients may be calculated as the average values for all 3 different substrates (i.e., glass coupons, plastic coupons, and stainless steel cups).

In some embodiments, a polysaccharide that is suitable for use in the method of the invention preferably provides:

(a) an average drying coefficient based on drying time being at the most 0.9, preferably at the most 0.8, more preferably at the most 0.7, even more preferably at the most 0.6, even more preferably at the most 0.5, even more preferably at the most 0.4, most preferably at the most 0.3, as being measured under identical conditions except for presence or absence of the polysaccharide to be tested in the rinse solution. The lower limit of this ratio typically may be about 0.1;

(b) an average drying coefficient based on remaining number of droplets being at the most 0.5, preferably at the most 0.4, more preferably at the most 0.3, even more preferably at the most 0.2, most preferably at the most 0.1, as being measured under identical conditions except for presence or absence of the polysaccharide to be tested in the rinse solution. The lower limit of this ratio may be 0; or both (a) and (b).

The rinse solution utilized in the present methods typically comprises water with or without polysaccharide (and optionally may comprise additional rinse aids). In some embodiments, the concentration of the tested polysaccharide in the rinse solution typically may be about 10 to about 50 ppm.

In assessing the (drying behavior for washware that has been rinsed as disclosed herein, care should be taken to choose suitable test conditions that illustrate differences in drying behavior with and without polysaccharide in the rinse. For instance, suitable test conditions may include those test conditions that illustrate a difference in drying when comparing a process that includes a common rinse aid added to the rinse water to a process that does not include added rinse components, (i.e., where compared to a process that includes rinsing with fresh water only). In a process that does not include added rinse components in the rinse water, the substrates typically are not dried within 5 minutes, giving an average number of remaining droplets between 5 and 25, while in a process that utilizes a standard rinse aid (e.g., a rinse aid that includes a surfactant) the average number of remaining droplets is less than half of this number. Suitable conditions are for instance those of example 1. A common rinse aid for purposes of comparison may be a nonionic surfactant dosed at about 100 ppm in the rinse water, for instance Rinse Aid A (see example 1).

In some embodiments, a polysaccharide useful as a rinse aid component according to the present disclosure adsorbs to washware and provides a sheeting effect in aqueous solution. In further embodiments, a polysaccharide useful as a rinse aid component according to the present disclosure may not reduce or may not substantially reduce the surface tension of water, as is a common property of a surfactant.

The presence of the polysaccharide in the rinse solution may reduce the contact angle for the rinse solution on a washware substrate. In some embodiments, a rinse solution that comprises about 1000 ppm of the polysaccharide (i.e., 0.1%) has a contact angle on a stainless steel substrate immersed in the solution that is reduced by more than about 10 degrees as compared to the contact angle for water only (without the polysaccharide) on the stainless steel substrate.

Polysaccharides

A polysaccharide as utilized herein is a polymer comprising monosaccharide units linked by glycosidic linkages. The monosaccharide unit may be an aldose or a ketose of 5 or 6 carbon atoms (e.g., ribose, arabinose, xylose, glucose, galactose, mannose) which optionally may be substituted or chemically modified. The polysaccharide may be a homopolysaccharide or a heteropolysaccharide, it may be linear or branched, and optionally may be chemically modified. In some embodiments, the polysaccharide is a cationic polysaccharide which may include, but is not limited to, quaternary nitrogen-containing cellulose ethers or cationic guar derivatives.

Preferably, the polysaccharide has a molecular weight of at least 2000 daltons, more preferably at least 5000 daltons.

Preferably, the polysaccharide is water-soluble at ambient temperatures.

Suitable polysaccharides may be cellulose-based, pectin-based, starch-based, natural gum-based, or combinations thereof.

Examples of cellulose-based polysaccharides include hydroxyethylcellulose, hydrophobically modified hydroxyethylcellulose, ethyl hydroxyethyl cellulose, hydrophobically modified ethyl hydroxyethyl cellulose, hydroxypropylcellulose or sodium carboxymethylcellulose. Such cellulose-based polysaccharides are sold under the trade name Bermocoll® by AkzoNobel or Natrosol®, Klucel® or Blanose® by Aqualon-Hercules.

Examples of natural gum-based polysaccharides include polygalactomannans (like guar gums or locust bean gums), polygalactans (like carrageenans), polyglucans (like xanthan gums), polymannuronates (like alginate), and gum arabic (or acacia gum). A non-exhaustive list of exemplary gums also includes agar (obtained from seaweed), beta-glucan (obtained from oat or barley bran), chicle gum (obtained from the chicle tree), dammar gum (obtained the sap of Dipterocarpaceae trees), gellan gum, glucomannan (obtained from the konjac plant), gum ghatti (obtained from the sap of Anogeissus trees), gum tragacanth (obtained from the sap of Astragalus shrubs), karaya gum (obtained from the sap of sterculia trees), mastic gum (obtained from the mastic free), psyllium seed husks (obtained from the Plantago plant), spruce gum (obtained from spruce trees), and tara gum (obtained from the seeds of the tara tree).

Preferred natural gums may be based on guar. Natural gums may include modified guars such as guar gum 2-hydroxypropyl ether or cationically modified guars such as Guar gum 2 hydroxy-3-(trimethylammonium)propyl ether. Suitable modified guars are sold under the trade name Jaguar® by Rhodia.

Starches may include natural or modified starches. Preferred starches include those derived from sources like potato or maize.

Suitable polysaccharides for the compositions and methods disclosed herein may include cationic polysaccharides such as cationic starch or cationic gum. Cationic starch or gum may be produced by treating a slurry of partially swollen granules of starch or gum with a reactive compound such as a reactive compound containing a quaternary nitrogen (e.g., a reactive alkylammonium salt such as epoxypropyltrimethylammonium chloride). The reagent may attach to the starch or gum at a hydroxyl group of a monosaccharide unit (e.g., the C6 hydroxyl group) via a reactive group of the reagent to produce a starch having a monosaccharide unit that is substituted with a quaternary ammonium group. For example, an epoxyalkylammonium salt may react with a hydroxyl group of a monosaccharide unit of a starch or gum via the epoxy group to produce a monosaccharide unit that is substituted with an alkylammonium group via an ether linkage (e.g., to produce an (ammonium)alkylether-modified starch). In some embodiments, the level of derivatization for the cationic starch or gum may be one to two charged groups per hundred monosaccharide units. Preferred starches or gums may include cationically modified starches or gums such as (3-Chloro-2-Hydroxypropyl) Trimethylammonium Chloride Modified Starch or Gum or 2-hydroxy-3-(trimethylammonium)propylether-modified starch or gum.

Particularly preferred are the following polysaccharides:

- Cationically modified guar gums; such as Guar gum, 2 hydroxy-3-(trimethylammonium)propyl ether chloride such as Jaguar® C 1000 (Rhodia).
- Cationically modified potato starch; such as HI-CAT® CWS 42 (Roquette Freres)
- Cellulose-based polysaccharides such as
- Hydroxyethylcellulose such as Natrosol® HEC 250 HHX (Aqualon-Hercules)
- Hydrophobically modified hydroxyethylcellulose such as Natrosol® HEC Plus 330 CS (Aquaion-Hercules)
- Ethyl hydroxyethyl cellulose such as Bermocoll® EBS 351 FQ (AkzoNobel)

These polysaccharides can be used singly or in combination with other polysaccharides.

Cationic polysaccharides, such as the Jaguar® polymers, may be combined with certain anions, such as phosphate and/or citrate and/or silicate and/or phosphonate anions or combined with acids or salts thereof as described below, such as citric acid, lactic acid, gluconic acid, acetic acid and/or phosphonic acid or salts thereof.

Rinse Aid Compositions

In addition to the polysaccharides described herein above, rinse aid compositions may comprise conventional ingredients, preferably selected from, but not limited to, surfactants, hydrotropes, builders (i.e., detergency builders including the class of chelating agents/sequestering agents), bleaching systems, acids, anti-scalants, corrosion inhibitors, and/or antifoamers.

Surfactants

Surfactants and especially nonionics optionally may be present to provide drying of the substrates in combination with the polysaccharide and/or to act as defoamer. Typically used nonionics are obtained by the condensation of alkylene oxide groups with an organic hydrophobic material which may be aliphatic or alkyl aromatic in nature, e.g. selected from the group consisting of a C2-C18 alcohol alkoxylate having EO, PO, BO and PEO moieties or a polyalkylene oxide block copolymer.

The nonionic surfactant may be present in a lower concentration than normally used in rinse aid compositions. In conventional rinse aid composition, the nonionic surfactant is present in a concentration of 10-30% (why). The presence of the polysaccharide allows for a reducton in nonionic concentration, such as at the most 10% (w/w), even for its complete absence.

Builder Materials

Builders that may be included in the rinse aid composition include phosphates, NTA, EDTA, MGDA, GLDA, citrates, carbonates, bicarbonates, polyacrylate/polymaleate, maleic anhydride/(meth)acrylic acid copolymers, e.g. Sokalan CP5 available from BASF.

Antiscalants

Antiscalants that that may be included in the rinse aid composition include polyacrylates of molecular weight from 1,000 to 400,000 and polymers based on acrylic acid combined with other moieties. These include acrylic acid combined with maleic acid; methacrylic acid; phosphonate; maleic acid and vinyl acetate; acrylamide; sulfophenol methallyl ether; 2-acrylamido-2-methylpropane sulfonic acid; 2-acrylamido-2-methylpropane sulfonic acid and sodium styrene sulfonate; methyl methacrylate, sodium methallyl sulfonate and sulfophenol methallyl ether; polymaleates; polymethacrylates; polyaspartates; ethylenediamine disuccinate; organo polyphosphonic acids and their salts. The antisealant, if present, is included in the composition from about 0.05% to about 10% by weight, preferably from 0.1% to about 5% by weight, most preferably from about 0.2% to about 2% by weight.

Bleaches

Suitable bleaches for use in the rinse aid composition may be halogen-based bleaches or oxygen-based bleaches. More than one kind of bleach may be used.

As halogen bleach, alkali metal hypochlorite may be used. Other suitable halogen bleaches are alkali metal salts of di- and tri-chloro and di- and tri-bromo cyanuric acids.

Suitable oxygen-based bleaches are the peroxygen bleaches, such as sodium perborate (tetra- or monohydrate), sodium carbonate or hydrogen peroxide.

Due to the feasibility of dosing polysaccharides in solid form, it is also feasible to conveniently dose solid bleaching agents, such as NaDCCA.

Acids

Acids may be incorporated in the rinse aid composition. Any suitable organic and/or inorganic acid in any suitable amount may be used. Suitable acids may include: acetic acid, aspartic acid, benzoic acid, boric acid, bromic acid, citric acid, formic acid, gluconic acid, glutamic acid, hydrochloric acid, lactic acid, malic acid, nitric acid, sulfamic acid, sulfuric acid, methane sulfonic acid, tartaric acid, phosphoric acid, oxalic acid, malonic acid, succinic acid, glutaric acid, adipic acid, and mixtures thereof. Acids are typically present in a rinse aid composition in the range from about 0.01% to about 30%.

Minor amounts of various other components may be present in the rinse aid. These include solvents and hydrotropes such as ethanol, isopropanol, xylene sulfonates and cumene sulfonates; anti-redeposition agents; corrosion inhibitors; and other functional additives.

Components of the rinse aid composition may independently be formulated in the form of solids (optionally to be dissolved before use), aqueous liquids or non-aqueous liquid (optionally to be diluted before use).

The rinse aid composition may be in liquid or solid form. The solid may be a powder, a granulated powder or a solid block or tablet. The liquid may be a conventional liquid, structured liquid, slurry or gel form.

The rinse method may be utilized in any of the conventional automatic institutional or domestic ware washing processes.

Typical institutional ware washing processes are either continuous or non-continuous and are conducted in either a single tank or a multi-tank/conveyor type machine. In the conveyor system pre-wash, wash, post-rinse and drying zones are generally established using partitions. Wash water is introduced into the rinsing zone and is passed cascade fashion back towards the pre-wash zone while the dirty dishware is transported in a counter-current direction.

Typically, an institutional warewash machine is operated at a temperature of between 45-65° C. in the washing step and about 80-90° C. in the rinse step. The washing step typically does not exceed 10 minutes, or even does not exceed 5 minutes. In addition, the rinse step typically does not exceed 2 minutes.

Typically, a domestic warewashing process takes about 30 minutes to 1.5 hour. The rinse cycles in these processes vary from about 5 to 40 minutes. Normally cold water is used for filling the domestic warewash machines. This water is heated up to about 60° C. during the wash process.

It is envisaged to use the rinse aid for periodically treating the ware. A treatment using a rinse aid comprising polysaccharide as described herein may be alternated with one or more washings using no rinse aid or a rinse aid without polysaccharide.

The rinse aid comprising a polysaccharide as described herein performs very well when soft water, or even reverse osmosis water, is used in the rinse step. Reverse osmosis water is often used for warewashing when high visual appearance of substrates, especially glasses, is important, because this type of water leaves no water residues. However, using standard rinse aids can have a negative effect on visual appearance (because of non-ionic residues), or spots can be formed when drying is not perfect. Perfect spot free drying of substrates can be achieved by using a rinse aid with polysaccharides, because the concentration of polysaccharide in the rinse flow can be very low and because very good drying is obtained by these polysaccharides.

The rinse aid comprising a polysaccharide also performs very well when tap water containing water hardness ions is used in the rinse step. Acids may be incorporated in the rinse aid to further decrease deposition of water hardness salts.

The rinse aid comprising a polysaccharide also performs very well when water with a high concentration of dissolved salts is used in the rinse step. This high level of salts in the rinse flow can deposit on the substrates and so have a negative effect on visual appearance of the substrates. The very good drying obtained by rinse aids with polysaccharides will lead to less deposition of salts and so improve visual appearance of the substrates.

The optimal drying behaviour obtained by the rinse aid with polysaccharides may also reduce the electrostatic properties of the substrates.

No effect on beer foam properties was observed as compared to a standard rinse process where nonionics from the rinse aid left behind on the glasses typically suppress the foam.

Potential benefits of this new rinse concept are for instance:

very effective drying is possible, better visual performance, very low concentrations of polysaccharide are feasible, some are more than a factor 10 more effective as compared to standard rinse aids based on non-ionics, dosing of solid is feasible, resulting into a very concentrated rinse aid, cost savings on product and packaging, good stability/compatibility with acids and/or bleaches like chlorine, potentially food approved materials, no need for a hydrotrope, some polysaccharides don't need defoamers, polysaccharides are easily dispersed, and therefore they can be dosed after the boiler in institutional processes.

In general this new rinse concept provides more formulation flexibility and improved drying performance.

The polysaccharide which provides optimal drying properties in this new rinse concept for ware washing processes may have some cleaning, defoaming, builder, binder, rheology modifying, thickening, structuring, scale prevention or corrosion inhibition properties as well and so improve the overall wash process.

This invention will be better understood from the examples which follow. However, one skilled in the art will readily appreciate that the specific methods and results discussed are merely illustrative and no limitation of the invention is implied.

EXAMPLE 1

In this example the drying behaviour of various substrates is tested in an institutional single tank warewash machine. A standard institutional wash process with soft water is applied for this test with a main wash process containing phosphate, caustic and hypochlorite.

First (test 1A: reference) the drying behaviour is determined for a wash process in which no rinse components are added to the last rinse solution. So the substrates are sprayed only with fresh soft water in the last rinse.

Then (test 1B) the drying behaviour of this wash process with a standard rinse process is determined. In this standard rinse process a rinse aid containing non-ionic surfactants is dosed in the rinse solution, just before it enters the boiler.

Then (test 1C) the drying behaviour is determined for a process in which the same standard rinse aid containing non-ionic surfactants is dosed in the rinse solution, after the boiler.

Then (tests 1D up to 1J) the drying behaviour is determined for various processes with rinse aids containing different polysaccharides. These rinse aids are prepared by dissolving or dispersing about 1% of the polysaccharides in water and these rinse aids are added to the last rinse solution, by dosing after the boiler.

The materials present in the rinse solutions in test 1D up to 1J are:

- Bermocoll® EBS 351 FQ (test 1D); ex AkzoNobel; Ethyl hydroxyethyl cellulose (medium viscosity grade).
- Natrosol® HEC Plus 330 CS (test 1E); ex Aqualon-Hercules; Modified hydroxyethylcellulose (CAS Number 80455-45-4).
- Natrosol® HEC 250 HHX (test 1F); ex Aqualon-Hercules; Hydroxyethylcellulose (CAS Number 9004-62-0).
- Jaguar® C 1000 (test 1G, 1H, 1I); ex Rhodia; Gomme de Guar, oxydee, 2-hydroxy-3-(trimethylammonio)propyl ether chlorure (CAS Nr: 71888-88-5).
- HI-CAT® CWS 42 (test 1J); ex Roquette Freres; cold water soluble cationic potato starch (CAS Nr: 56780-58-6).

In test 1H and 1I the effect of a combination of the cationic guar Jaguar® C 1000 with a salt on the drying behaviour was tested. In test 1H sodium tripoly phosphate and in 1I citric acid was added in combination with Jaguar® C 1000 to the rinse aid composition.

In Table 1 the concentrations of these materials in the rinse solutions for each of the components are mentioned.

The warewasher used for these tests is a Hobart®-single tank hood machine, which is automated for laboratory testing, such that the hood is opened and closed automatically and the rack with ware is transported automatically into and out off the machine.

Specifications Single Tank Hood Machine

Type: Hobart® AUX70E

Volume washbath: 50 L

Volume rinse: 4 L

Wash time: 29 seconds

Rinse time: 8 seconds

Wash temperature: 50° C.

Rinse temperature: 80° C.

Water: soft water (water hardness: <1 DH).

The conditions for drying substrates in these tests are most demanding. Relatively low temperature of main wash (50° C.) and rinse (80° C.) and relatively short main wash cycle (29 sec.) were applied; these conditions will lead to minimal heating up of the substrates and so drying is determined especially by components added to the last rinse cycle. Furthermore, substrates are selected which are very difficult to dry.

Process

When the wash bath is filled with soft water and heated up, the wash program is started. The washwater is circulated in the machine by the internal wash pump and the wash arms over the dishware. When the wash time is over, the wash pump stops and the wash water stays in the reservoir below the substrates. Then 4 L of the wash bath is drained automatically by a pump into the drain. Then the rinse program starts; warm water from the boiler (connected to the soft water reservoir) rinses by the rinse arms over the dishware. Rinse components can be added to this rinse water via a pump and injected just before or after the boiler. When the rinse time is over the machine is opened.

Working Method

Once the machine is filled with soft water and temperature of water is 50° C., the main wash powder is added. Main wash powder is: 0.53 g/l sodium tripoly phosphate (STP; LV 7 ex-Rhodia)+0.44 g/l sodium hydroxide (NaOH)+0.03 g/l dichloroisocyanuric acid Na-salt.2 aq (NaDCCA).

The polysaccharides are dissolved or dispersed at about 1% in an aqueous solution and so forming the rinse aid composition. The rinse aids are injected via a pump into the last rinse solution, just before or after the boiler. The concentration of rinse components in the last rinse is determined by the concentration and volume of dosed rinse aids and the water flow of the last rinse.

Drying times are measured on 3 different types of substrates. These substrates are selected because they are difficult to dry in a warewash process without rinse components and only moderately dried with a standard rinse aid process. These substrates are made of the following, practically relevant, materials:

- 2 glass coupons (148*79*4 mm)
- 2 plastic ('Nytralon 6E' (Quadrant Engineering Plastic Products); naturel) coupons (97*97*3 mm)
- 2 stainless steel cups (110*65*32 mm), model: Le Chef, supplier: Elektroblok BV.

After the wash cycle (29 seconds) and rinse cycle (8 seconds) the drying time is determined (in seconds) of the substrates at ambient temperature. When drying time is longer than 300 s, it is reported as 300 s. However, many of the substrates are not dried within five minutes. In that ease, the remaining droplets on the substrates are also counted.

The wash and rinse cycle and drying measurements are repeated two more times with the same substrates. The substrates are replaced for every new test (in order not to influence the drying results by components possibly adsorbed onto the ware).

TABLE 1

Drying results for different components added to the rinse solution

| | Component | Concentration in rinse | Stainless steel Time; Sec. | Stainless steel Number Droplets | Glass Time; Sec. | Glass Number Droplets | Plastic Time; Sec. | Plastic Number Droplets | Drying Coefficient Drying time | Drying Coefficient Number of remaining droplets |
|---|---|---|---|---|---|---|---|---|---|---|
| 1 A | No components added to rinse Reference test | — | 300 | 21 | 300 | 5 | 300 | 24 | — | — |
| 1 B | Rinse Aid A non-ionics Dosed before boiler | 90 ppm | 300 | 10 | 118 | 0 | 299 | 3 | 0.80 | 0.20 |
| 1 C | Rinse Aid A non-ionics Dosed after boiler | 153 ppm | 300 | 15 | 107 | 0 | 300 | 15 | 0.79 | 0.45 |
| 1 D | Bermocoll ® EBS 351 FQ | 33 ppm | 190 | 1 | 135 | 1 | 280 | 1 | 0.67 | 0.10 |
| 1 E | Natrosol ® HEC Plus 330CS | 31 ppm | 198 | 2 | 64 | 0 | 300 | 8 | 0.62 | 0.14 |
| 1 F | Natrosol ® HEC 250 HHX | 29 ppm | 262 | 1 | 94 | 0 | 263 | 2 | 0.69 | 0.04 |
| 1 G | Jaguar ® C 1000 | 11 ppm | 140 | 0 | 20 | 0 | 300 | 4 | 0.51 | 0.06 |
| 1 H | Jaguar ® C 1000 STPP | 12 ppm 80 ppm | 77 | 0 | 20 | 0 | 300 | 5 | 0.44 | 0.07 |
| 1 I | Jaguar ® C 1000 Citric acid | 11 ppm 22 ppm | 118 | 0 | 40 | 0 | 264 | 2 | 0.47 | 0.03 |
| 1 J | HI-CAT ® CWS 42 | 25 ppm | 126 | 0 | 41 | 0 | 174 | 1 | 0.38 | 0.02 |

Results

Table 1 compiles the results of these tests series. For the stainless steel substrates, glass and plastic coupons both the average values of the drying times and the average values of the number of droplets on the coupons after five minutes for the 3 repeat tests are given.

The drying behaviour of these components added to the last rinse can also be quantified by the drying coefficient. This can be calculated both for the drying time and the number of remaining droplets after 5 minutes and is corresponding to the ratio:

$$\frac{\text{Drying time using rinse aid with added component}}{\text{Drying time using rinse aid without added component(reference test 1A)}}$$

or $$\frac{\text{Number of droplets after 5 minutes using rinse aid with added component}}{\text{Number of droplets after 5 minutes using rinse aid without added component}}$$

A better drying behaviour corresponds to a lower drying coefficient.

In Table 1 the drying coefficients are calculated for the various wash processes. The drying coefficients are calculated as the average value for all 3 different substrates.

In test 1A the drying effects are measured for a dish wash process in which no rinse components are present in the last rinse solution. This reference test shows that on all selected substrates many droplets are left behind, even after 5 minutes, when is rinsed with water only and no rinse components are used in the rinse process.

In test 1B the drying effects are measured for a representative standard dish wash process in which drying of the substrates is obtained by rinsing with a rinse solution in which rinse aid containing non-ionic surfactants is dosed. These rinse components are dosed via a separate rinse pump just before the boiler into the last rinse water. Minimally three wash cycles are done before the test starts, in order to be sure that the rinse aid is homogenously distributed through the boiler.

In this example Rinse Aid A is used as representative rinse aid. This neutral rinse aid contains about 30% of a non-ionic mixture. By dosing this rinse aid at a level of 0.3 g/L, the concentration of non-ionics in the rinse solution is about 90 ppm. Key components of Rinse Aid A are given in Table 2.

TABLE 2

| As supplied | Raw material | Trade name |
|---|---|---|
| 22.5% | Alcohol (C13-15) alkoxylate (EO/BO) (95%) | Plurafac LF221 |
| 7.5% | Alcohol alkoxylate (EO/PO) | Plurafac LF403 |
| 5.0% | Cumene sulphonic acid Na-salt (40%) | Eltesol SC40 |
| 65.0% | Water | Water |

The drying results of test 1B with standard rinse aid are much better than for a process without any rinse components (test 1A), but this test also confirms that indeed these substrates are difficult to dry. Under these standard wash and rinse conditions, only the glass coupons get dried, while on the plastic and stainless steel substrates still several water droplets are left behind after 5 minutes.

In test 1C the drying effects are measured for a process in which the same rinse aid A is injected in the last rinse, after the boiler. The results show that, despite the higher level of non-ionics in the last rinse solution, drying is worse as compared to injecting the rinse aid before the boiler (test 1B). This is probably caused by the poor dispersability of the non-ionics in the rinse solution. When the rinse aid is dosed before the boiler, the flow through the boiler will help to distribute the non-ionics more homogenously over the rinse solution and so leading to better drying effects.

In test 1D up to 1J the rinse aids containing polysaccharides are injected in the last rinse after the boiler. The results of these tests shows that the presence of these polysaccharides in the last rinse lead to very good drying effects. These results are much better than for the standard rinse aid dosed after the boiler, but also better than for this standard rinse aid dosed before the boiler. Obviously, these polysaccharides used in test 1D up 1J provide very good drying properties, even when dosed after the boiler. Furthermore, it is remarkable that these good drying properties are obtained at concentrations which are much lower than the concentration of non-ionics dosed via the standard rinse aid.

Especially the cationic guar Jaguar® C 1000 provides excellent drying properties under these conditions, even at the extremely low concentration of 11 ppm in the rinse solution. The drying properties of Jaguar® C 1000 are further improved by combining this component with a salt like sodium tripoly phosphate (test 1H) or citric acid (test 1I) in the rinse aid composition. Furthermore, the cationic potato starch provides very good drying at 25 ppm in the rinse solution, on all substrates.

EXAMPLE 2

In this example the surface tension is measured of solutions containing polysaccharides, leading to proper drying in example 1D-1G. In the same way the surface tension is measured for solutions containing standard rinse aids. These standard rinse aids, selected at random, are used both in domestic dishwash processes as in institutional dishwash processes. All these standard rinse aids contain nonionic surfactants.

Solutions from the polysaccharides are made by dissolving 1000 ppm (0.1%) in soft water by stirring for 10 minutes at 50° C. Solutions of the rinse aids are made by dissolving the standard rinse aids in soft water leading to 1000 ppm of nonionic surfactant (based on the average value given on the product ingredient declaration.

The surface tension is measured at room temperature with a bubble pressure tensiometer (KRÜSS PocketDyne). Setting are as follows: Short surface age (50-250 ms for water). Ten different measurements are done with every solution and the average value is calculated.

Tested materials are:

2A water only; reference test.

2B-2G are solutions containing standard rinse aids.

2B Rinse aid A; ex JohnsonDiversey; see example 1; industrial dishwash rinse aid; 30% nonionic surfactant.

2C Green Pro; ex Ecolab Ltd.; industrial rinse additive; 15-30% nonionic surfactants.

2D Crystal Fusion; Geosystem 9000; ex Ecolab Ltd; rinse additive.

2E Sun Abrilhantador/spoelglans; ex Unilever; 5-15% nonionic surfactants.

2F Calgonit Shine Active; glansspoelmiddel-rincage; ex Reckitt Benckiser; 5-15% nonionic surfactant.

2G Actiff Liquide de rincage Spoelmiddel Abrillantodor Abrilhantodor; ex Mc Bride; 5-15% nonionic surfactants.

2H-2K are solutions containing polysaccharides, as also used in example 1D-1G.

In Table 3 the measured surface tensions are given.

TABLE 3

Surface tension for solutions containing standard rinse aids (leading to 1000 ppm non-ionic surfactant in solution) or 1000 ppm polysaccharides.

| Test nr. | Component | Surface tension mN/m |
|---|---|---|
| 2A | Water only | 72 |
| | Test 2B-2G: standard rinse aids | |
| 2B | Rinse aid A | 48 |
| 2C | Green Pro | 44 |
| 2D | Crystal Fusion | 49 |
| 2E | Sun Abrilhantador | 42 |
| 2F | Calgonit Shine Active | 49 |
| 2G | Actiff Liquide de rincage | 46 |
| | Test 2H-2K polysaccharides | |
| 2H | Bermocoll ® EBS 351 FQ | 64 |
| 2I | Natrosol ® HEC Plus 330CS | 70 |
| 2J | Natrosol ® HEC 250 HHX | 67 |
| 2K | Jaguar ® C 1000 | 72 |

These results clearly show that the surface tension of water is reduced significantly when standard rinse aids are present. All measured values for test 2B-2G are below 50 mN/m. This is well known state of the art for developing rinse aids for dishwash processes. A reduction in surface tension of the rinse solution leads to a lower contact angle of rinse water on the substrates and so better drying properties. Better drying will, in general, be obtained with a rinse solution having a lower surface tension.

At the other hand, the surface tension of water is not reduced or only marginally when the polysaccharides are present. All measured values for test 2H-2K are above 60 mN/m.

These data confirm that it is very remarkable that proper drying is obtained with these polysaccharides (example 1). Obviously, drying by polysaccharides in the rinse solution is based on a different concept than for standard rinse aids.

EXAMPLE 3

In this example the contact angle of water is measured on substrates which were contacted with solutions containing polysaccharides, leading to proper drying in example 1D-1G.

Solutions from polysaccharides are made by dissolving 1000 ppm in soft water by stirring for 10 minutes at 50° C.

Stainless steel coupons (type 304) were immersed for 20 minutes in solution of these polysaccharides at 50° C., while stirring. These coupons were rinsed for 10 seconds with softened water to remove attached solution and dried at room temperature.

Contact angles of water on these coupons were measured using an FTA 200 (First Ten Angstroms)-apparatus. The prop Shape Method was applied during the measurements.

Tested materials are:

3A Reference test in which coupons were immersed in water only.

Test 3B-3E are solutions containing polysaccharides, as also used in example 2.

In Table 4 the measured contact angles are given.

TABLE 4

Contact angles of water on stainless steel substrates immersed in water or solutions containing 1000 ppm polysaccharides.

| Test nr. | Component | Contact angle; degrees |
|---|---|---|
| 3A | Water only | 92 |
| 3B | Bermocoll ® EBS 351 FQ | 81 |
| 3C | Natrosol ® HEC Plus 330CS | 66 |
| 3D | Natrosol ® HEC 250 HHX | 71 |
| 3E | Jaguar ® C 1000 | 73 |

These results show that the contact angle of water on substrates is reduced significantly when these substrates are immersed in solutions containing polysaccharides. These results indicate that the polysaccharides adsorb on the substrates and so create a hydrophilic surface layer. This adsorption can explain the proper drying results when applying these polysaccharides in a rinse aid of a dishwash process as described in example 1.

EXAMPLE 4

In this example the drying behaviour is tested for a liquid rinse aid containing one of the preferred polysaccharides from example 1: Jaguar® C 1000. The following polysaccharide containing rinse aid (PS-RA 1) was prepared by adding the raw materials in given order:

TABLE 5

Composition PS-RA 1

| order | Raw material | % |
|---|---|---|
| 1 | Soft water | 83% |
| 2 | Jaguar ® C1000 (ex Rhodia) | 2% |
| 3 | Dequest ® 2000 (50% Amino tri (methylene phosphonic acid), ex Thermphos) | 5% |
| 4 | Lactic acid (90%) | 10% |

Rinse aid A (composition as in example 1) is used as reference for comparison in this test. Drying tests were carried out with the same test method as described in example 1. In this example, tap water containing 8 degrees German Hardness was applied. Furthermore, extra salt (NaCl 1000 ppm) was added to the rinse flow to create very critical drying conditions.

In the main wash solution the following detergent was dosed at 0.5 g/L:

TABLE 6

Liquid main wash detergent

| Raw material | % |
|---|---|
| Soft water | 27% |
| Dequest ® 2000 (ex Thermphos) | 2% |
| Caustic soda (50% NaOH solution) | 20% |
| Trilon A liquid (40% NTA-Na3 ex BASF) | 51% |

Standard non-ionic based Rinse aid A was dosed at 0.3 g/L, so leading to a concentration of non-ionic in the rinse flow of about 90 ppm. PS-RA 1 was dosed at 0.5 g/L, so leading to a concentration of 10 ppm polysaccharide in the rinse flow.

Besides drying time and remaining number of droplets, also visual appearance of the substrates was evaluated. A score was given for each of the substrates varying from 0 (extremely bad with many visual marks and scale deposition) to 10 (very good with no visual depositions on the substrate). This lead to the following results:

TABLE 7

Drying results for nonionic based rinse aid A and polysaccharide based rinse aid

| | Stainless steel | | Glass | | Plastic | |
|---|---|---|---|---|---|---|
| Rinse aid | Time sec. | Droplets | Time sec. | Droplets | Time sec. | Droplets |
| Rinse aid A | 300 | 15 | 200 | 0 | 298 | 4 |
| PS-RA 1 | 205 | 4 | 76 | 0 | 300 | 7 |

TABLE 8

Visual appearance: average score of all substrates

| Rinse aid | Score |
|---|---|
| Rinse aid A | 5.4 |
| PS-RA 1 | 7.4 |

These results confirms that PS-RA 1 containing polysaccharide provides very good drying properties; better than for a standard rinse aid based on nonionics. Furthermore, visual appearance of substrates rinsed with the polysaccharide containing rinse aid is significantly better than for substrates rinsed with the nonionic based rinse aid, under these critical conditions.

EXAMPLE 5

In this example the drying behaviour is tested for a liquid rinse aid containing one of the preferred polysaccharides: Jaguar® C 1000. The following polysaccharide containing rinse aid (PS-RA 2) was prepared by adding the raw materials in given order:

TABLE 9

Composition PS-RA 2

| order | Raw material | % |
|---|---|---|
| 1 | Soft water | 87.3% |
| 2 | Jaguar ® C1000 (ex Rhodia) | 1.7% |
| 3 | Gluconic acid (50%) | 6% |
| 4 | Acetic acid (80%) | 5% |

After mixing these raw materials, the product was heated to 30 degrees C. for 30 minutes. This process and this combination of acids resulted into the formation of a stable product.

Rinse aid A (composition as in example 1) is used as reference for comparison in this test. Drying tests were carried out with the same test method as described in example 1. The same liquid main wash detergent as in example 4 (table 6) was added into the main wash at 1 g/L, in soft water.

Standard non-ionic based Rinse aid A was dosed at 0.3 g/L, so leading to a concentration of non-ionic in the rinse flow of about 90 ppm. PS-RA 2 was dosed at 0.6 g/L, so leading to a concentration of 10 ppm polysaccharide in the rinse flow.

TABLE 10

| Drying results for nonionic based rinse aid A and polysaccharide based rinse aid | | | | | | |
|---|---|---|---|---|---|---|
| | Stainless steel | | Glass | | Plastic | |
| Rinse aid | Time sec. | Droplets | Time sec. | Droplets | Time sec. | Droplets |
| Rinse aid A | 300 | 16 | 225 | 0 | 200 | 0 |
| PS-RA 2 | 96 | 1 | 29 | 0 | 270 | 1 |

This example confirms that PS-RA 2 containing polysaccharide provides very good drying properties; better than for a standard rinse aid based on non-ionics.

EXAMPLE 6

In this example the drying behaviour is tested for a polysaccharide containing rinse aid in a wash and rinse process with Reverse Osmosis (RO) water. The following polysaccharide containing rinse aid (PS-RA 3) was prepared by adding the raw materials in given order:

TABLE 11

| Composition PS-RA 3 | |
|---|---|
| Raw material | % |
| Soft water | 93% |
| Jaguar ® C1000 (ex Rhodia) | 2% |
| Dequest 2000 (50% Amino tri (methylene phosphonic acid), ex Thermphos) | 5% |

Drying tests were carried out with the same test method as described in example 1. In this example, RO-water was applied in main wash and in the rinse flow.

In the trials of this example, the mainwash contained the following main wash powder: 0.40 g/l sodium tripoly phosphate (STP; LV 7 ex-Rhodia)+0.40 g/l sodium metasilicate 5 Aq.+0.03 g/l dichloroisocyanuric acid Na-salt. 2 aq (NaDCCA).

First (reference test 6A) the drying behavior is determined for a wash process in which no rinse components are present, so rinsed only with fresh RO-water.

Then (test 6B) the drying behaviour is determined for the same wash process with dosing standard Rinse aid A (composition as in example 1) in the rinse flow at 0.3 g/L, leading to about 90 ppm nonionic in the rinse flow.

Then (test 6C) the drying behaviour is determined for the wash process with dosing polysaccharide rinse aid PS-RA 3 at 0.2 g/L, leading to 4 ppm polysaccharide in the rinse flow.

TABLE 12

| Drying results with RO-water | | | | | | |
|---|---|---|---|---|---|---|
| | Stainless steel | | Glass | | Plastic | |
| | Time; Sec. | Droplets | Time; Sec. | Droplets | Time; Sec. | Droplets |
| 6A No components added to rinse. Reference test. | 300 | 20 | 300 | 6 | 300 | 25 |
| 6B Rinse aid A | 300 | 9 | 124 | 0 | 300 | 5 |
| 6C PS-RA 3 | 300 | 3 | 30 | 0 | 300 | 5 |

TABLE 13

| Drying coefficients | | | |
|---|---|---|---|
| | | Drying Coefficient | |
| | | Drying time | Number of remaining droplets |
| 6A | No components added to rinse. Reference test | — | — |
| 6B | Rinse aid A | 0.80 | 0.22 |
| 6C | PS-RA 3 | 0.70 | 0.12 |

The substrates were also evaluated visually on spots (water marks), when they were totally dried.

TABLE 14

| Visible spots on substrates | | | |
|---|---|---|---|
| | Stainless steel | Glass | Plastic |
| 6A | Yes | Yes | Yes |
| 6B | Yes | Yes | Yes |
| 6C | No | No | Yes |

This example confirms that the rinse aid containing polysaccharide provides also very good drying properties in RO-water, even at the very low concentration of 4 ppm polysaccharide in the rinse flow. The results are significantly better than for a standard rinse aid, leading to faster drying, less remaining droplets and improved visual appearance.

EXAMPLE 7

In this example the drying behaviour is tested for some solid rinse aids containing polysaccharides. These tests are executed in a so called 'low temp' dishwash machine.

First (test 7A: reference) the drying behaviour is determined for a wash process in which no rinse components are added to the rinse flow. So the substrates are sprayed only with fresh water in the last rinse.

Then (test 7B) the drying behaviour of this wash process with a standard rinse process is determined. In this process Rinse aid A containing non-ionic surfactants (composition as in example 1) is dosed in the rinse water.

Then (tests 7C up to 7F) the drying behaviour is determined for wash processes in which different polysaccharide containing rinse aids are dosed in the rinse flow. These rinse aids were dosed as solid components directly in the rinse water.

The materials present in the rinse solutions in test 7C up to 7F are:

Jaguar® C 1000 (test 7C); ex Rhodia; Gomme de Guar, oxydee, 2-hydroxy-3-(trimethylammonio)propyl ether chlonire (CAS Nr: 71888-88-5).

Jaguar® C 162 (test 7D); ex Rhodia; Guar, 2-Hydroxypropyl- and 2-Hydroxy-3-(trimethylammonium)propyletherchloride (CAS Nr: 71329-50-5).

HI-CAT® CWS42 (test 7E, 7F); ex Roquette Freres; cold water soluble cationic potato starch (CAS Nr: 56780-58-6).

In Table 15 the concentrations of these materials in the rinse solutions for each of the components are mentioned. In test 7B Rinse aid A was dosed at 0.3 g/L leading to about 90 ppm nonionics in the rinse solution. In test 7C till 7 E each of the solid polysaccharides was dosed at 0.03 g/L in the rinse solution. In test 7 F, a mixture of solid HI-CAT® CWS42 and solid NaDCCA (dichloroisocyanuric acid Na-salt) was dosed, leading to a concentration of respectively 30 ppm HI-CAT® CWS 42 and 50 ppm NaDCCA in the rinse solution.

ber of droplets. After the first measurement, the rinse water is drained and the machine is filled with fresh wash water. The wash and rinse cycle and drying measurements are repeated two more times with the same substrates.

Note: in practice with these type of machines, rinse water is often not drained directly after the rinse but re-used as wash water for the main wash after addition of main wash detergent. However, in this example, rinse water is drained directly after the rinse to avoid any drying effect from these rinse components in the main wash solution. So, the rinse aid can only be effective in the rinse solution, in this example.

Results

The results from these tests are given in table 15. The average values of the drying times and the average values of the number of droplets on the coupons after five minutes for the 3 repeat tests are given. Furthermore, the drying coefficients are calculated.

TABLE 15

Drying results for different rinse aids added to the rinse solution

| | | | Stainless steel | | Glass | | Plastic | | Drying Coefficient | |
|---|---|---|---|---|---|---|---|---|---|---|
| | Component | Concentration in rinse | Time; Sec. | Number Droplets | Time; Sec. | Number Droplets | Time; Sec. | Number Droplets | Drying time | Number of remaining droplets |
| 7 A | No components added to rinse Reference test | — | 300 | 19 | 300 | 14 | 300 | 27 | — | — |
| 7 B | Rinse Aid A; non-ionics | 90 ppm | 240 | 1 | 273 | 1 | 300 | 4 | 0.90 | 0.11 |
| 7 C | Jaguar C1000 | 30 ppm | 225 | 6 | 149 | 0 | 300 | 8 | 0.75 | 0.23 |
| 7 D | Jaguar C162 | 30 ppm | 248 | 3 | 272 | 2 | 300 | 11 | 0.91 | 0.27 |
| 7 E | HI-CAT CWS 42 | 30 ppm | 132 | 0 | 76 | 0 | 300 | 5 | 0.56 | 0.09 |
| 7 F | HI-CAT CWS 42<br>NaDDCA | 30 ppm<br>50 ppm | 117 | 0 | 70 | 0 | 282 | 4 | 0.52 | 0.06 |

Wash Process

The warewasher used for these tests is an Auto-Chlor 'low temp' single tank hood machine.

Specifications Single Tank Hood Machine

Type: Auto-Chlor Model A5

Volume washbath: 5 L

Volume rinse: 5 L

Wash time: 56 seconds

Rinse time: 24 seconds

Wash temperature: 55° C.

Rinse temperature: 55° C.

Water: soft water (water hardness: <1 DH).

When the wash bath is filled with soft water of 55° C., main wash detergent is added and the wash program is started. The washwater is circulated in the machine by the internal wash pump via the wash arms over the dishware. When the wash time is over, the wash pump stops and the total wash bath is drained automatically by a pump into the drain. Then the rinse program starts; fresh water (of 55° C.) rinses via the wash arms over the dishware and is circulated in the machine by the internal wash pump. In this example, the rinse components were added manually into the rinse solution. When the rinse time is over the machine is opened.

Working Method

The working method used in this example is similar to the working method described in example 1. The main wash solution had similar composition as in example 1.

Drying behaviour was determined on the same substrates by measuring drying time and, when needed, remaining num- These tests show that, when no rinse component is present in the rinse solution (test 7A), the drying behaviour on all substrates is poor.

The drying results of test 7B with standard Rinse aid A are much better than for a process without any rinse components (test 7A).

Test 7 C up to 7 E show that the rinse solutions containing various polysaccharides can have comparable or better drying results than standard rinse aid A. However, the dosages of these solid rinse aids were a factor of 10 less than the dosage of liquid Rinse aid A.

Furthermore, the solid rinse aid containing cationic potato starch and NaDCCA, also leads to perfect drying (test 7 F). This example illustrates one of the benefits of this new rinse concept. Solid polysaccharides can be easily combined with other solid components, without risk of storage instability effects. In most standard, non-ionic based, liquid rinse aids bleaches or sanitisers like chlorine can not be incorporated because of storage instability effects.

The invention claimed is:

1. A method for washing ware in an automatic ware washing machine, the method comprising:

(a) contacting the ware during a wash cycle with an aqueous cleaning solution, and (b) contacting the washed ware during a rinse cycle with an aqueous rinse solution in which a rinse aid composition is dosed, wherein the rinse aid composition contains a sufficient amount of a polysaccharide to provide a layer of polysaccharide on the ware and to provide a sheeting action during the rinse cycle;

wherein:

the polysaccharide is a cationic starch-based polysaccharide, and further wherein the cationic starch-based polysaccharide is selected to provide an improved drying behavior of the washed ware corresponding to the ratio of drying time using rinse aid with cationic starch-based polysaccharide to drying time using rinse aid without cationic starch-based polysaccharide being at the most 0.5, and further corresponding to the ratio of number of droplets after 5 minutes using rinse aid with cationic starch-based polysaccharide to number of droplets after 5 minutes using rinse aid without cationic starch-based polysaccharide being at the most 0.1, and further wherein the cationic starch-based polysaccharide is (3-chloro-2-hydroxypropyl)trimethylammonium chloride modified potato starch.

2. The method according to claim 1, wherein the polysaccharide is present in the rinse aid composition in a concentration of 0.01 to 100% (w/w).

3. The method according claim 1, wherein the rinse aid composition further comprises a non-ionic surfactant at a concentration of no more than about 10% (w/w).

4. The method according to claim 1, wherein the rinse aid composition is in liquid, structured liquid, slurry or gel form.

5. The method according to claim 1, wherein the rinse aid composition is in the form of a powder, granulated powder, tablet or solid block.

6. The method according to claim 1, wherein the rinse aid composition does not comprise a nonionic surfactant.

7. The method according to claim 1, wherein the automatic ware washing machine is an automatic institutional ware washing machine.

8. A method for washing ware in an automatic ware washing machine, the method comprising:

(a) contacting the ware during a wash cycle with an aqueous cleaning solution, and (b) contacting the washed ware during a rinse cycle with an aqueous rinse solution in which a rinse aid composition is dosed, wherein the rinse aid composition contains a sufficient amount of a polysaccharide to provide a layer of polysaccharide on the ware and to provide a sheeting action during the rinse cycle;

wherein the polysaccharide is (3-chloro-2-hydroxypropyl) trimethylammonium chloride modified potato starch.

* * * * *